US010378845B2

(12) United States Patent
Nakamura

(10) Patent No.: US 10,378,845 B2
(45) Date of Patent: Aug. 13, 2019

(54) SMART GUN DESIGN AND SYSTEM FOR A SUSTAINABLE SOCIETY

(71) Applicant: Research Foundation of the City University of New York, New York, NY (US)

(72) Inventor: Masato Nakamura, New York, NY (US)

(73) Assignee: Research Foundation of the City University of New York, New York, NY (US)

( * ) Notice: Subject to any disclaimer, the term of this patent is extended or adjusted under 35 U.S.C. 154(b) by 0 days.

(21) Appl. No.: 16/196,807

(22) Filed: Nov. 20, 2018

(65) Prior Publication Data

US 2019/0154380 A1 May 23, 2019

Related U.S. Application Data

(60) Provisional application No. 62/588,684, filed on Nov. 20, 2017.

(51) Int. Cl.

| | |
|---|---|
| ***F41A 17/08*** | (2006.01) |
| ***F41A 17/06*** | (2006.01) |
| ***F41A 17/30*** | (2006.01) |
| ***F41A 17/54*** | (2006.01) |

(52) U.S. Cl.

CPC ..... *F41A 17/066* (2013.01); *F41A 17/08* (2013.01); *F41A 17/30* (2013.01); *F41A 17/54* (2013.01)

(58) Field of Classification Search

CPC ..... F41A 17/06; F41A 17/066; F41A 17/08; F41A 17/54

See application file for complete search history.

(56) References Cited

U.S. PATENT DOCUMENTS

2007/0129152 A1* 6/2007 Tsai ..... A63F 9/0291 463/49
2017/0299335 A1* 10/2017 Stantchev ..... F41G 3/08
2018/0238649 A1* 8/2018 Winiecki ..... F41A 17/063

FOREIGN PATENT DOCUMENTS

WO WO-2005079288 A2 * 9/2005 ..... F41A 17/06

OTHER PUBLICATIONS

Hayes, J.; Smart Gun Technology; HDIAC Journal; 2016; pp. 1-7; vol. 3 • Issue 3.

Greene, M.; A Review of Gun Safety Technologies; National Institute of Justice Research Report; Jun. 2013; 96 pages.

* cited by examiner

*Primary Examiner* — Stephen Johnson
(74) *Attorney, Agent, or Firm* — Peter J. Mikesell; Schmeiser, Olsen & Watts, LLP

(57) ABSTRACT

A smart gun is provided that maintains a default locked state. The smart gun can be selectively unlocked for a predetermined period of time using a predetermined gesture that is detected by a gyrosensor locked in the smart gun.

8 Claims, 4 Drawing Sheets

SMART GUN DESIGN AND SYSTEM FOR A SUSTAINABLE SOCIETY

CROSS-REFERENCE TO RELATED APPLICATIONS

This application claims priority to and is a non-provisional of U.S. Patent Application 62/588,684 (filed Nov. 20, 2017) the entirety of which is incorporated herein by reference.

BACKGROUND OF THE INVENTION

Gun violence is one of the major public issues for a sustainable society. In the United States, the number of suicide deaths by gun is larger than that of homicide by gun. More than 60 percent of gun deaths are suicides. Accidental use of gun by children is also a significant concern. Minimization of these problems is therefore desirable. To date, no system has proven to be entirely satisfactory. Therefore, an improved system is desirable that addresses at least some of these concerns.

The discussion above is merely provided for general background information and is not intended to be used as an aid in determining the scope of the claimed subject matter.

BRIEF DESCRIPTION OF THE INVENTION

In a first embodiment, a smart gun is provided. The smart gun comprising: a handheld firearm with a trigger; a gyrosensor for sensing an incoming gesture pattern; a distance sensor disposed at a muzzle of the handheld firearm; a battery; a computer processor that stores a predetermined gesture pattern and receives data from the gyrosensor and the distance sensor; a servo system in communication with the computer processor that selectively locks and unlocks the trigger such that: the trigger is unlocked for a predetermined period of time after the incoming gesture pattern matches the predetermined gesture pattern provided no object is within a predetermined distance as determined by the proximity sensor; the trigger is locked after the predetermined period of time has elapsed; the trigger is locked when an object is detected by the proximity sensor within the predetermined distance of the proximity sensor.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

This disclosure provides a system that applies customizable gesture combinations for identifying authorized firearm users. The system includes using a 3-axis gyroscope, an accelerometer, a magnetometer (e.g. a compass) and a global positioning system (GPS) is also utilized. In some embodiments a proximity sensor, which is configured to detect an object in an extremely close range, is present in order to avoid self-shooting or children's accidental use. Using this gesture-detecting system, firearm users can customize gesture combinations that unlock a gun during an authorization process. This smart gun system emits an encrypted signal including time, location, and 3-dimensional direction of the gun muzzle when the trigger is pulled. The signal with the data will be transferred through a cellular network or a WIFI connection, and eventually stored to a server. For example, the firearm can store a predetermined location that is assigned by putting zip cords or street names (ex: "11201, 11202", or "area between 42nd and 59th streets, and between 5th avenue and Broadway.") The GPS unit determines if the firearm is within the predetermined location and enables or disables the firearm accordingly.

Figure 1:
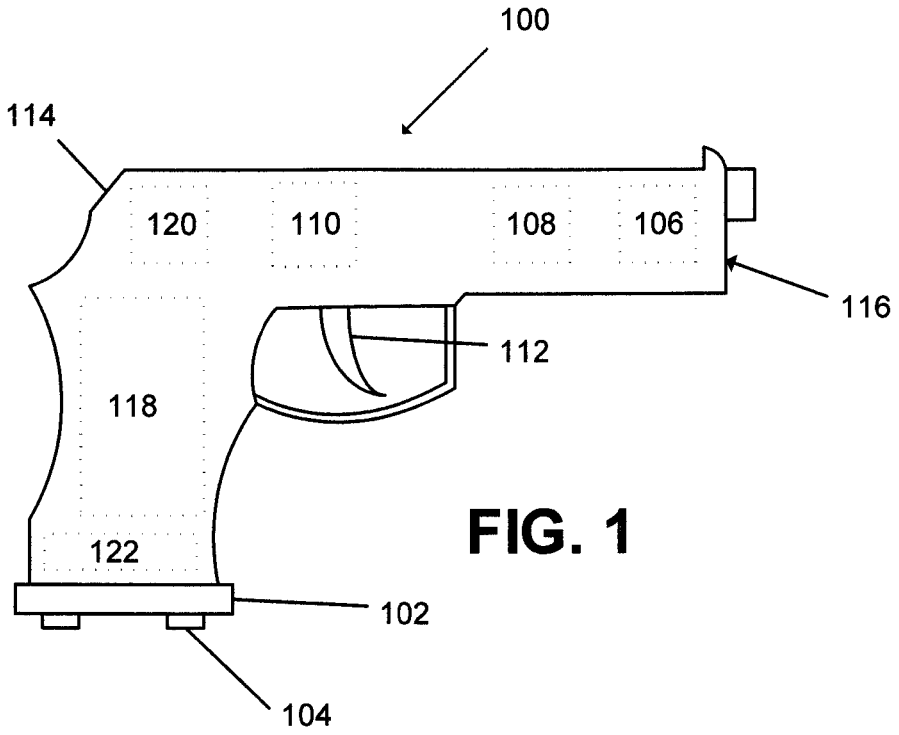
FIG. 1 is a schematic of one smart gun.

Referring to FIG. 1, a smart gun 100 is depicted. The smart gun 100 comprises a battery 102 that recharges using electrodes 104 that attach to a recharging station 204 (see FIG. 2). The smart gun 100 further comprises a gyroscope sensor 106, a GPS system 108 and a servo system 110 for engaging and disengaging the trigger 112. The GPS system 108 is in electrical communication with an antenna 114. A distance sensor 116 is disposed at the muzzle of the smart gun 100. A motor controller 118 is present that operates the servo system 110. A magnetometer 120 (e.g. a compass) is also present. A processor 122 is also provided that controls and/or receives data from the aforementioned sensors and systems.

Figure 2:
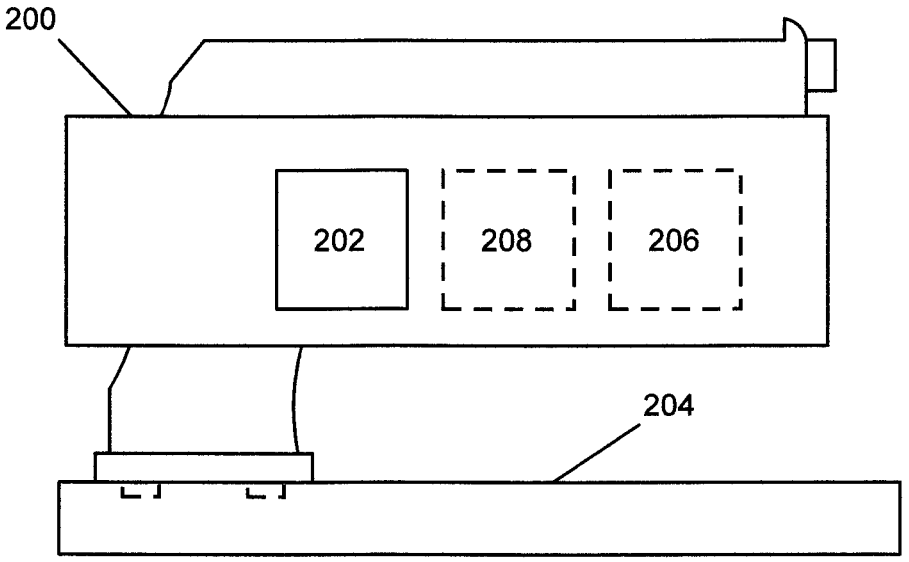
FIG. 2 depicts the smart gun in a trigger guard.

FIG. 2 depicts the smart gun 100 with a trigger guard 200 engaged. The trigger guard 200 blocks a user from operating the trigger. A fingerprint scanner 202 is disposed on an external surface of the trigger guard 200. In practice, a user places at least one finger on the fingerprint scanner 202 and the user's fingerprint is scanned. The scanned fingerprint is compared to a reference fingerprint that is stored in a data storage unit 206. If the fingerprints match, then the trigger guard 200 actuates and the smart gun 100 is released, thereby permitting the user to operate the smart gun 100. If the fingerprints do not match, then the trigger guard 200 does not actuate and the smart gun 100 remains inoperable.

The trigger guard 200 comprises a data storage unit 206 that can store the reference fingerprint. A processor 208 is also provided for processing data that is received from the fingerprint scanner 202 or data that is stored in the data storage unit 206. In one embodiment, the data storage unit 206 can exchange data with the processor 122 when the smart gun 100 is engaged with the trigger guard 200. This permits duplication of the data stored in the data storage unit 206 and the processor 122.

Figure 3A:
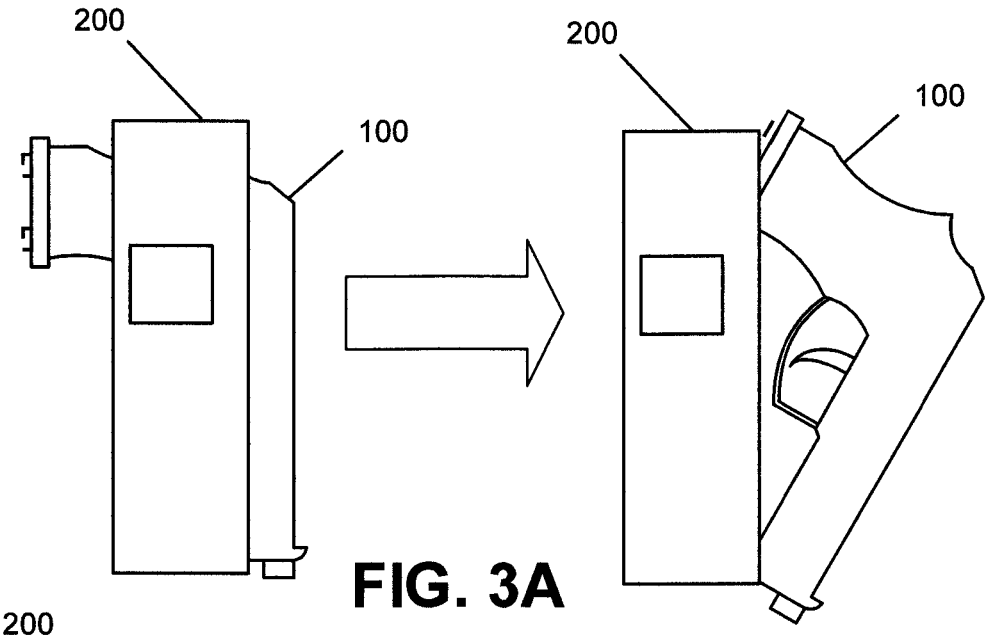
FIG. 3A depicts the trigger guard in additional detail.
Figure 3B:
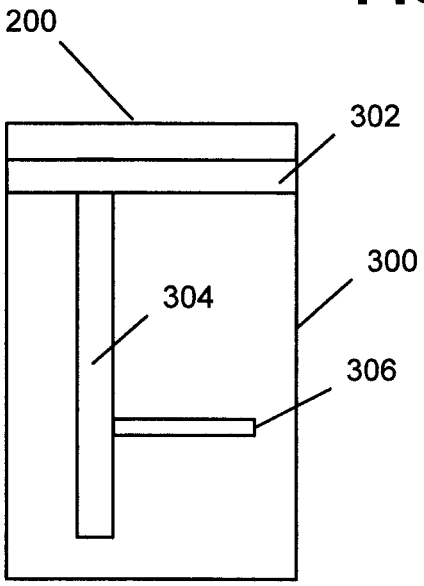
FIG. 3B is a top view of the trigger guard.
Figure 3C:
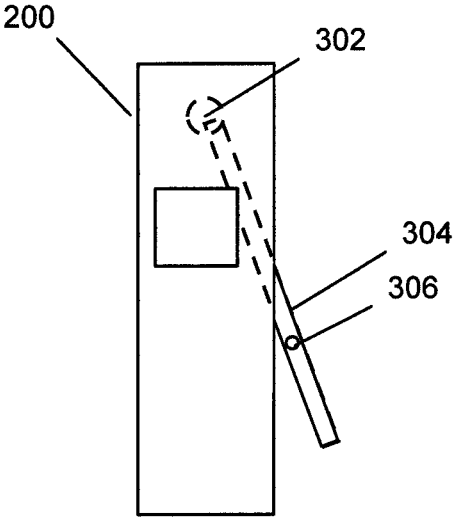
FIG. 3C is a side view of the trigger guard.

Referring to FIG. 3A, the smart gun 100 is shown being removed from the trigger guard 200. FIG. 3B provides a top view of the trigger guard 200. The trigger guard 200 comprises two parallel plates 300 that are spaced from each other to receive the smart gun 100 while blocking access to the trigger 112. A pivot bar 302 is directly attached to each of the parallel plates 300. A lever 304 is connected to the pivot bar 302. A peg 306 extends perpendicular to the pivot bar 302 and is spaced to securely mate with the smart gun 100 (e.g. through the trigger guard). When the trigger guard 200 releases the smart gun 100, the lever 304 pivots about the pivot bar 302 such that the peg 306 clears the parallel plates 300 as shown in FIG. 3B. This permits removal of the smart gun 100.

Even after the smart gun 100 is removed from the trigger guard 200 the servo system 110 provides a second safety feature by disengaging the trigger 112 until such time as a gesture combination is provided. The processor 122 can actuate the servo system 110 when a gesture combination that matches a predetermined gesture combination is detected. The gesture combination is detecting using the gyroscope sensor 106.

The gyroscope sensor 106 include a 3-axis acceleration sensor. A predetermined gesture combination is stored in the memory of processor 122. One example of a predetermined gesture combination is tilting the smart gun 100 at a 45° pitch relative to its starting position and then returning the smart gun 100 to its starting position, provided the gesture is completed within 1 second. In the gravity-independent mode, the starting position provides an arbitrary initial reference point. A second example of a predetermined gesture combination is tilting the smart gun 100 at a 90° counter-clockwise roll relative to its starting position and then returning the smart gun 100 to its starting position, provided the gesture is completed within 1 second. A third example of a predetermined gesture combination is tilting the smart gun 100 at a 90° counter-clockwise roll relative to its starting position, then 180° clockwise roll (thus being 90° from the initial position) and then returning the smart gun 100 to its starting position, provided the gesture is completed within 2 seconds. A fourth example of a predetermined gesture combination is tilting the smart gun 100 at a 90° pitch relative to its starting position and then returning the smart gun 100 to its starting position, provided the gesture is completed within 1 second. A fifth example of a predetermined gesture combination is tilting the smart gun 100 at a 90° leftward yaw relative to its starting position, then 180° rightward yaw (thus being 90° from the initial position) and then returning the smart gun 100 to its starting position, provided the gesture is completed within 2 seconds. The gesture combination may be measured in a gravity-sensitive mode or a gravity-independent mode. In the gravity-sensitive mode, the starting position places the barrel of the smart gun 100 parallel to the ground.

The predetermined gesture combination is stored in the processor 122 and can be altered using conventional methods. For example, a computer can wirelessly connect to the smart gun 100 using antenna 114. The ability to alter the predetermined gesture combination can be safeguarded using traditional password protection. In another embodiment, a wired connection to a computer is utilized.

The predetermined gesture combination can be programmed to change on a set schedule. For example, a first predetermined gesture combination may be used Monday to Friday while a second predetermined gesture combination automatically applies on weekends. Once the trigger 112 is engaged, it remains engaged for a predetermined period of time (e.g. 10 seconds, 10 minutes, 3 hours, one day, etc.). Multiple predetermined gesture combinations can be programmed with each combination having its own predetermined period of time. For example, a first predetermined gesture combination can engage the trigger 112 for 5 minutes while a second predetermined gesture combination can engage the trigger 112 for 1 hour. When the predetermined period of time has elapsed the trigger 112 automatically becomes disengaged by the automatic activation of the servo system 110. This maintains the smart gun 100 in a deactivated state by default.

The smart gun 100 also comprises a distance sensor 116 that can detect objects that are within a predetermined distance of the front of the smart gun 100. The processor 122 can actuate the serve system 110 using the motor controller 118 when such an object is determined within the predetermined distance. The predetermined distance is typically set to be relatively short (e.g. one foot, two feet, etc.). This can prevent the smart gun 100 from accidently firing when pointing toward an individual. This can prevent damage from situations such as mishandling of the smart gun 100 by a child and attempted suicides. Examples of suitable distance sensors include sonar sensors (e.g. ultrasound sensors) and infrared sensors.

In one embodiment, an electrical charge from the battery 102 may be used as part of an electroshock weapon. For example, the smart gun 100 could be equipped with dart-like electrodes at the muzzle of the smart gun 100. These electrodes can be fired and, upon making contact with a target, provide an electrical discharge through connecting wires that can stun the target.

Figure 4A:
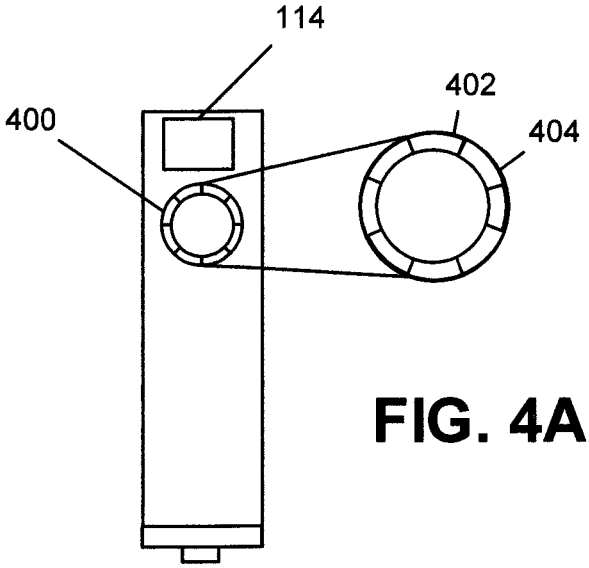
FIG. 4A is a rear view of the smart gun showing the LED indicator depicting safety features.
Figure 4B:
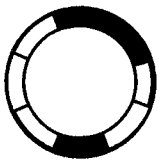
FIG. 4B, FIG. 4C and FIG. 4D shows the LED indicator with safety feature indicators selectively activated.
Figure 4C:
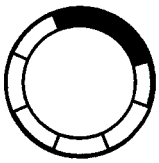
Figure 4D:
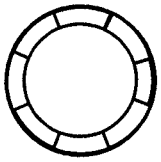

FIG. 4A depicts a rear view of the smart gun 100 that shows a LED indicator 400 with a plurality of individual LEDs (e.g. LED 402 and LED 404). Each individual LED is configured to graphically display the status of one of the safety features. For example, LED 402 may turn red when the trigger 112 is locked due to the lack of a current gesture combination. Similarly, LED 404 may turn red when the smart gun 100 is inoperable because the trigger guard 200 is engaged. As each of the individual safety features is properly resolved, the corresponding LED turns green. In FIG. 4B, three safety features are engaged that prevent the smart gun 100 from being operable. In FIG. 4C, two safety features are engaged that prevent the smart gun 100 from being operable. In FIG. 4D, all safety features have been addressed (i.e. zero safety features are engaged) and the smart gun 100 is operable.

The smart gun 100 may be locked based on geographic location (as determined by GPS system 108) as one of the safety features. For example, the smart gun 100 may be unlocked when the smart gun 100 is (1) within a predetermined geographic location (e.g. within a certain state, a certain city and/or a certain vicinity) and (2) the predetermined gesture combination is provided.

Figure 5:
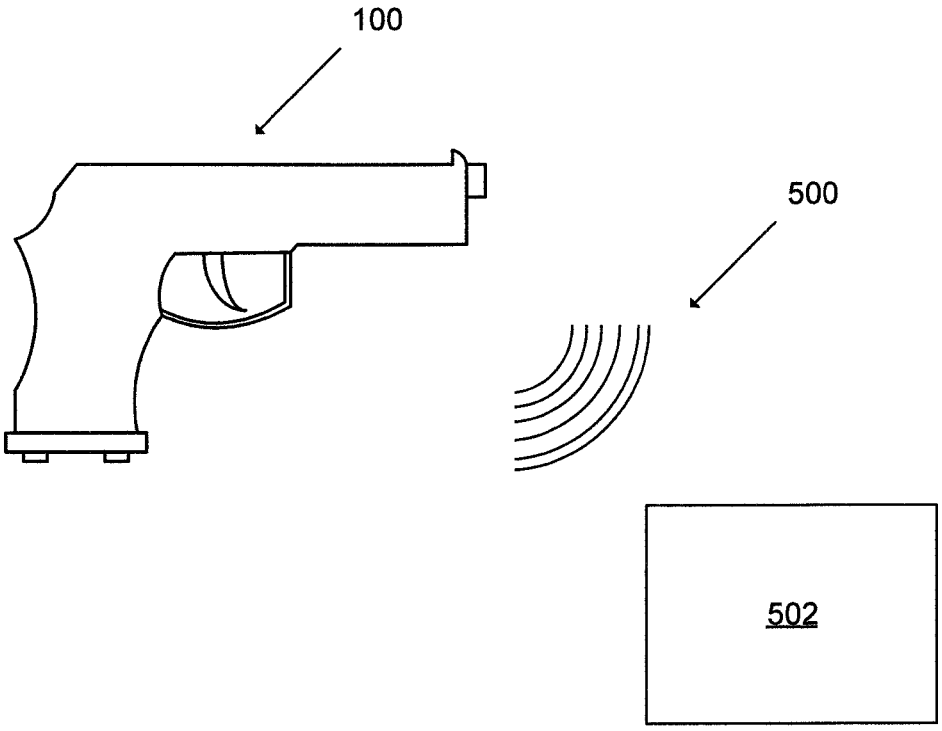
FIG. 5 shows the smart gun wirelessly communicating with a wireless unit.

Referring to FIG. 5, when the smart gun 100 is fired, a wireless signal 500 is transmitted from antenna 114 that contains information about the environment where the firing occurred. The processor 122 sends information such as a unique smart gun identification number, the current time, the geographic location (as determined by GPS system 108), the direction of the smart gun 100 when fired (as determined by the magnetometer and the gyro sensor 106). The wireless signal may be received by a receiving unit 502. The receiving unit may be a wireless unit 502 that is specifically configured to communicate with the smart gun 100 and relay the information to a predesignated server. If the smart gun 100 is out of range of a wireless unit 502, the information may be stored in processor 122 until such time as the smart gun 100 is in range of a wireless unit 502 at which time the information is automatically transmitted. The time is determined with a clock module that is present in processor 122.

The information that is transmitted can be analyzed at a remote server using machine learning, data science, and/or behavioral science. The analyzed gunfire information accumulated from each smart gun can be used to predict users' behaviors, preventing unnecessary gun use, and reducing potential gun violence. This information permits data acquisition and local storage that, in turn tracks evidence of actions in a situation where firearms are used. This information clearly provides a timestamp when fired.

The remote server can engage in two-way communication with the smart gun 100 by transmitted data and/or instructions through the wireless unit 502 and the antenna 114. For example, the remote server can transmit a lock code to the smart gun 100 to prevent the smart gun 100 from being unlocked. The remote server can also query the location of the smart gun 100 and prompt a reply wherein information is retrieved from the processor 122.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A smart gun comprising:

a handheld firearm with a trigger;

a gyrosensor for sensing an incoming gesture pattern;

a distance sensor disposed at a muzzle of the handheld firearm;

a battery;

a computer processor that stores a predetermined gesture pattern and receives data from the gyrosensor and the distance sensor;

a servo system in communication with the computer processor that selectively locks and unlocks the trigger such that:

the trigger is unlocked for a predetermined period of time after the incoming gesture pattern matches the predetermined gesture pattern provided no object is within a predetermined distance as determined by the proximity sensor;

the trigger is locked after the predetermined period of time has elapsed;

the trigger is locked when an object is detected by the proximity sensor within the predetermined distance of the proximity sensor.

2. The smart gun as recited in claim 1, further comprising a trigger guard that engages with the trigger to lock the trigger.

3. The smart gun as recited in claim 2, wherein the trigger guard comprises a fingerprint scanner configured to scan a scanned fingerprint of a user and release the trigger guard if the scanned fingerprint matches a reference fingerprint.

4. The smart gun as recited in claim 3, wherein the trigger guard comprises a data storage unit that stores the reference fingerprint.

5. The smart gun as recited in claim 2, further comprising an antenna that transmits a wireless signal when the smart gun is fired.

6. The smart gun as recited in claim 5, wherein the antenna is configured to receive a remote lock signal that uses the servo system to lock the trigger and override the gyrosensor such that unlocking is prevented.

7. The smart gun as recited in claim 1, further comprising a global positioning system (GPS) for receiving incoming location information of the smart gun, wherein the smart gun is unlocked if the incoming location information matches a predetermined location and is locked if the incoming location information is not within the predetermined location.

8. The smart gun as recited in claim 1, further comprising a light emitting diode (LED) indicator disposed on a rear surface of the smart gun, wherein the LED indicator depicts a locked status or an unlocked status of the smart gun.

* * * * *